US006077032A

United States Patent [19]

Wolfe, Jr. et al.

[11] Patent Number: 6,077,032

[45] Date of Patent: Jun. 20, 2000

[54] HOUSING ASSEMBLY FOR A VACUUM CLEANER

[75] Inventors: Melvin E. Wolfe, Jr., Hallstead; Mark E. Baer, Williamsport, both of Pa.

[73] Assignee: Felchar Manufacturing Corporation, Kirkland, N.Y.

[21] Appl. No.: 09/118,128

[22] Filed: Jul. 16, 1998

[51] Int. Cl.[7] ..... F04D 5/00; F04D 23/00; F01D 1/02

[52] U.S. Cl. ..... 415/53.2; 415/208.2

[58] Field of Search ..... 415/206, 208.1, 415/208.2, 208.3, 209.1, 210.1, 211.2, 224, 226, 52.1, 53.1, 53.2

[56] References Cited

U.S. PATENT DOCUMENTS

| | | | |
|---|---|---|---|
| 1,496,633 | 6/1924 | Hertzler | 415/208.3 X |
| 2,477,681 | 8/1949 | Anderson . | |
| 2,778,563 | 1/1957 | Doyle . | |
| 2,884,185 | 4/1959 | Dolan . | |
| 2,942,556 | 6/1960 | Growall | 415/206 X |
| 3,229,070 | 1/1966 | Wells | 415/206 X |
| 3,240,000 | 3/1966 | Hayes et al. . | |
| 3,263,909 | 8/1966 | Mazepa . | |
| 3,272,129 | 9/1966 | Leopold | 415/206 X |
| 3,398,866 | 8/1968 | La Flame et al. . | |
| 3,791,772 | 2/1974 | Keimpema et al. . | |
| 3,848,290 | 11/1974 | Bates . | |
| 4,128,364 | 12/1978 | Papst et al. | 415/206 X |
| 4,512,713 | 4/1985 | Berfield . | |
| 4,655,694 | 4/1987 | Berfield . | |
| 4,669,952 | 6/1987 | Forsyth, III et al. . | |
| 4,733,429 | 3/1988 | Jacob et al. . | |
| 4,797,072 | 1/1989 | Berfield et al. . | |
| 4,808,090 | 2/1989 | Evans . | |
| 4,859,144 | 8/1989 | Houston . | |
| 4,934,017 | 6/1990 | Kent . | |
| 5,102,296 | 4/1992 | Kimberlin . | |
| 5,104,541 | 4/1992 | Daniel | 415/206 X |
| 5,137,424 | 8/1992 | Daniel | 415/206 |
| 5,454,690 | 10/1995 | Wolfe et al. | 415/208.2 X |
| 5,813,831 | 9/1998 | Matsunaga et al. | 415/206 X |

*Primary Examiner*—John E. Ryznic
*Attorney, Agent, or Firm*—Marshall, O'Toole, Gerstein, Murray & Borun

[57] ABSTRACT

A motor housing for a vacuum cleaner includes a main body, a peripheral rim, and an interconnecting base bounding portions of a working air chamber. A portion of the peripheral rim defines a sidewall having a plurality of vanes and a plurality of exhaust openings, with the vanes and the exhaust openings cooperating to exhaust air from the working air chamber in response to rotation of the impeller. Each of the vanes having an airfoil-shaped cross section, and each vane is oriented such that the airfoil of each vane is oriented oppositely relative to the airfoil of its adjacent vanes. Thus, a first set of the vanes are positioned to direct air through the exhaust openings, while a second set of vanes are positioned to direct excess air from adjacent the exhaust openings toward the chamber and back into the flow pattern. The excess air is thus smoothly remixed at a different velocity with the air moving through the working air chamber such that synchronization of the air flow is reduced, and harmonic induced noise is minimized.

23 Claims, 3 Drawing Sheets

HOUSING ASSEMBLY FOR A VACUUM CLEANER

FIELD OF THE INVENTION

The present invention relates to a housing assembly having a plurality of vanes or blades for exhausting air from a chamber. More specifically, the present invention relates to housing having a plurality of oppositely facing, airfoil shaped exhaust vanes.

BACKGROUND OF THE INVENTION

Most vacuum cleaners use an impeller which rotates inside a chamber to draw working air through the vacuum unit. The working air drawn in by the impeller must be exhausted continuously during operation of the vacuum unit, and thus the design of the surrounding motor housing is of utmost importance. A properly designed motor housing can greatly enhance the efficiency of the vacuum unit, and can also serve to minimize excess noise created by the air flowing through the vacuum cleaner.

In order to exhaust the working air from within the motor housing, the peripheral sidewall of the motor housing is typically equipped with a plurality of blades or vanes separated by a plurality of exhaust openings. The flow of air through the exhaust openings can be altered by changing the number, size and shape of the exhaust openings and the sidewall vanes. With each rotation of the impeller, a portion of the working air within the housing is exhausted, while the remaining or excess portion of the air remains within the housing. In order to minimize noise, this excess air must be smoothly reintroduced into the flow pattern.

A variety of vane shapes have been employed in an effort to increase efficiency and minimize noise. U.S. Pat. No. 4,669,952 discloses a quiet by-pass vacuum motor having a fan end bracket with separating wedges or members which extend from an outer wall to an inner wall and which define passageways to exhaust vents, while U.S. Pat. No. 4,859,144 discloses a two-stage motor fan system. Other approaches to minimizing noise include employing irregularly shaped impeller blades, as disclosed in U.S. Pat. No. 3,398,866.

Nevertheless, there exists a continuing need for an improved motor housing design that will result in improved efficiency and that will minimize noise. There also exists a need for an improved housing design that is cost effective to produce using standard molding practices.

SUMMARY OF THE INVENTION

The improved motor housing of the present invention provides for efficient airflow with a minimum of exhaust noise. The housing includes a peripheral sidewall having a plurality of exhaust openings and a plurality of airfoil shaped blades or vanes, with the airfoil shape of each vane being oriented in an opposite direction or orientation relative to its adjacent vanes. Thus, one blade will smoothly and efficiently draw working air through an exhaust opening and out of the housing, while the next, oppositely disposed blade will smoothly reintroduce the excess air back into the flow pattern. The change of direction alters the velocity of the working air in the flow pattern, which reduces the noise level by minimizing the harmonic effects of a synchronized air flow. This pattern of smooth exhaust followed by a smooth, lower velocity reintroduction of the excess air back into the flow pattern is repeated around the periphery of the housing sidewall.

According to one aspect of the invention, a motor housing for a vacuum cleaner includes a main body, a peripheral rim, and an interconnecting base bounding portions of a working air chamber. A portion of the peripheral rim defines a sidewall having a plurality of vanes and a plurality of exhaust openings, with the vanes and the exhaust openings cooperating to exhaust air from the working air chamber. Preferably, each of the vanes has an airfoil shaped cross-section, and each vane is oriented such that the airfoil of each vane is oriented oppositely relative to the airfoil of its adjacent vanes. Preferably, there are an even number of vanes, such as eighteen vanes spaced circumferentially about the housing and formed integrally in the housing sidewall.

The vanes are divided into two sets. The first set of the vanes are positioned to direct air through the exhaust openings, while the second set of vanes are positioned to direct excess air from adjacent the exhaust openings toward the chamber. The excess air is thus smoothly remixed at a different velocity with the air moving through the working air chamber such that synchronization of the air flow is reduced, and harmonic induced noise is minimized. Preferably, each of the vanes in the first set are separated by the vanes in the second set.

Each of the vanes has an upstream edge facing the airflow path and a downstream edge. The vanes in the first set have a broadened or thickened upstream edge and a narrowed downstream edge, while the vanes in the second set have a narrowed upstream edge and a broadened downstream edge. Each of the vanes in the first set includes an exit surface for directing air away from the path and through an adjacent one of the exhaust openings. Conversely, each of the vanes in the second set includes a return surface for directing the excess portion of the air back into the air flow path.

According to another aspect of the invention, a housing for a vacuum device comprises a main body, a peripheral rim, and an interconnecting base bounding portions of a working air chamber. A portion of the peripheral rim defines a sidewall having a plurality of vanes, and each of the vanes has a wedge-shaped cross section. Each of the vanes is separated from its adjacent vanes by an exhaust opening. The wedge-shaped cross section of each of the vanes is oriented oppositely relative to the wedge-shaped cross section of its adjacent vanes. A first set of the vanes cooperates with the exhaust openings to exhaust air from the working air chamber, while a second set of the vanes acts to smoothly recirculate excess air within the working air chamber to minimize noise.

According to yet another aspect of the invention, a vacuum cleaner housing comprises a main body, a peripheral rim, and an interconnecting base bounding portions of a working air chamber. A portion of the peripheral rim defines a sidewall, and the sidewall includes exhaust vane means defined in part by a plurality of paired vane units spaced circumferentially about the peripheral rim. The sidewall further includes a plurality of exhaust openings cooperating with the vane means to exhaust air from the housing.

According to still another aspect of the invention, a motor housing for a vacuum cleaner, comprises a main body, a peripheral rim, and an interconnecting base bounding portions of a working air chamber for confining air moving along a path, with a portion of the peripheral rim defining a sidewall. The housing includes exhaust means for exhausting air from the chamber, with the exhaust means including exit vane means integrally formed in and circumferentially spaced about the sidewall for exhausting air from the chamber. The housing further includes recirculation vane means integrally formed in and spaced circumferentially about the sidewall for recirculating air in the chamber.

These and other objects, features and advantages of the present invention will become readily apparent to those skilled in the art upon a reading of the following description and claims.

DETAILED DESCRIPTION OF THE INVENTION

The following detailed description is not intended to limit the invention to the precise form disclosed. The embodiments described in detail have been chosen in order to best explain the principles of the invention so that others skilled in the art may follow its teachings.

Figure 1:
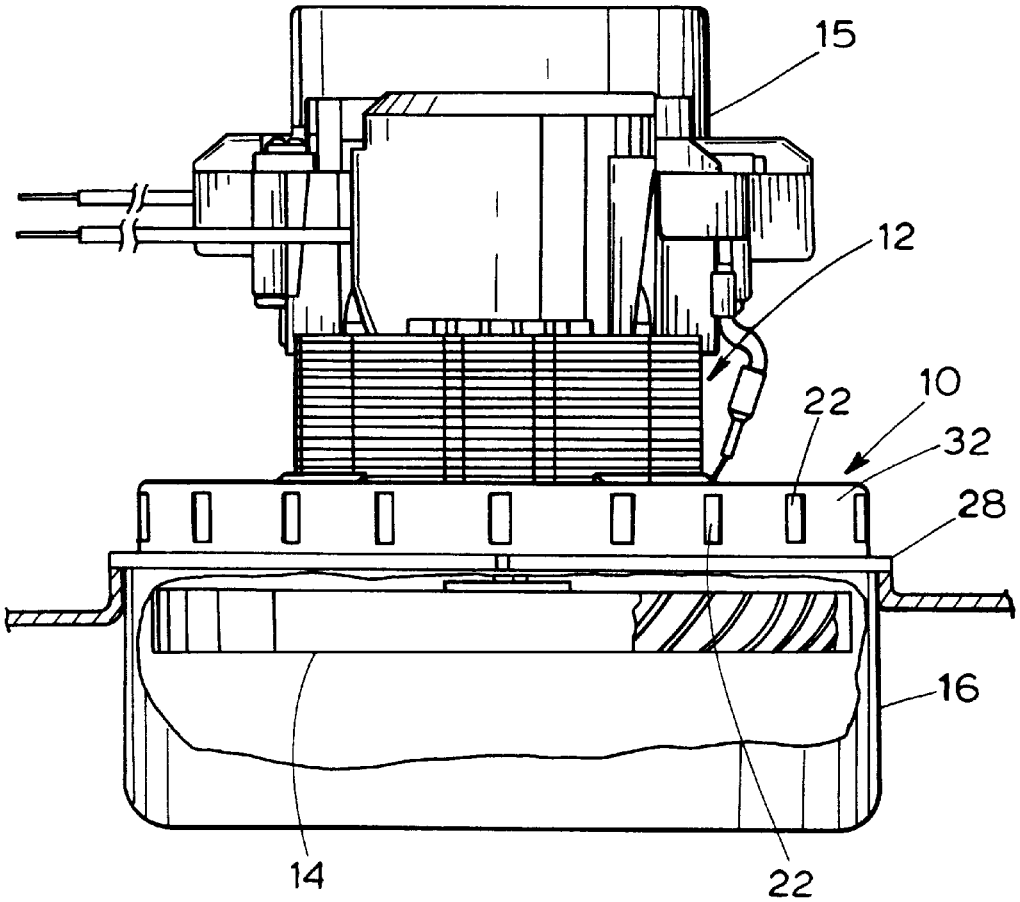
FIG. 1 is a fragmentary elevational view of a vacuum cleaner motor assembly incorporating the motor housing of the present invention.

Referring now to the drawings, FIG. 1 shows a motor housing incorporating the features of the present invention which is generally indicated by the reference numeral 10 and which is shown attached to a motor assembly 12 of the type commonly employed in the art. As shown in FIGS. 1 and 3, motor assembly 12 includes an impeller 14 (shown in phantom in FIG. 1) housed within a lower impeller housing 16 enclosing a working air chamber 18. The impeller 14 is rotatable by virtue of a drive motor 15. The housing 10 is preferably provided with a plurality of mounting bosses 17 (FIGS. 2 and 3) which permit attachment to the motor assembly 12 in a manner well known in the art.

As shown in FIG. 3, the lower impeller housing 16 includes an air inlet 20, while the motor housing 10 includes a plurality of air outlets 22, such that working air can flow through the working air chamber 18 between the air inlet 20 and the air outlets 22 along an air flow path 24. The impeller 14, the motor 15, and the impeller housing 16 may be of the type disclosed in U.S. Pat. No. 5,454,690, the disclosure of which is hereby incorporated herein by reference. Alternatively, other suitable designs for the impeller, the motor, and the impeller housing may be employed as would be contemplated by one skilled in the art.

Figure 2:
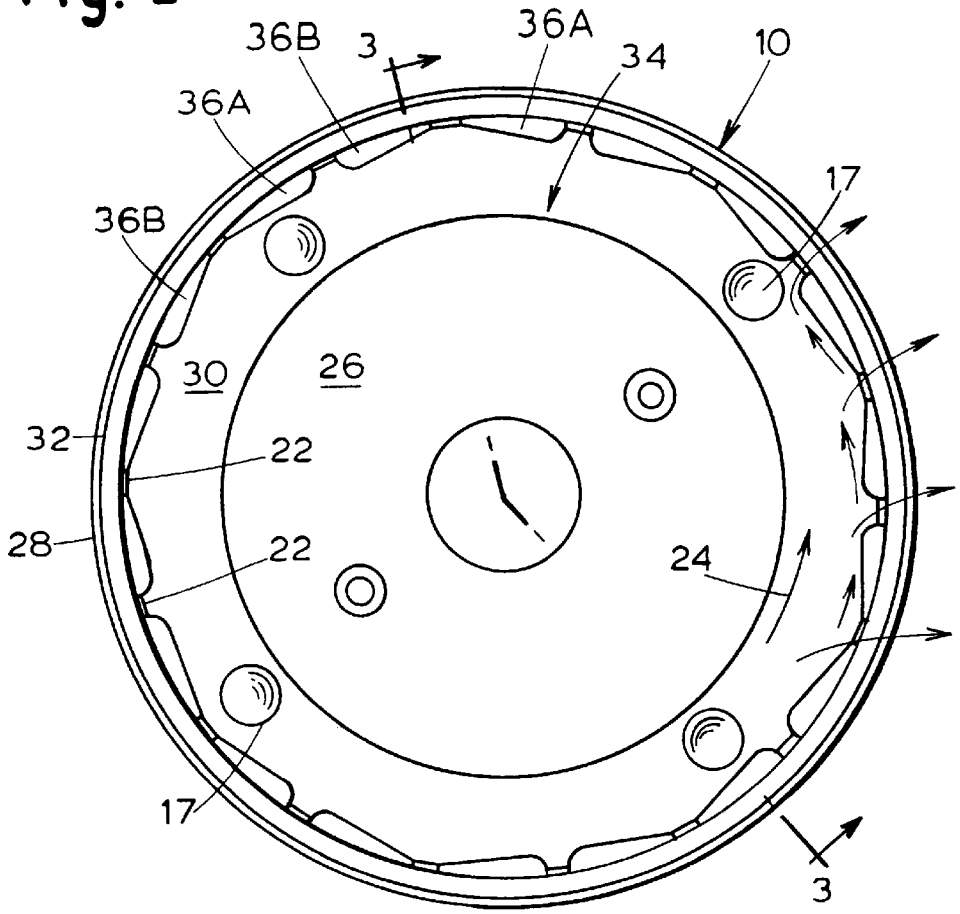
FIG. 2 is a top elevational view, taken along lines 2—2 of FIG. 1, of the motor housing of the present invention.
Figure 3:
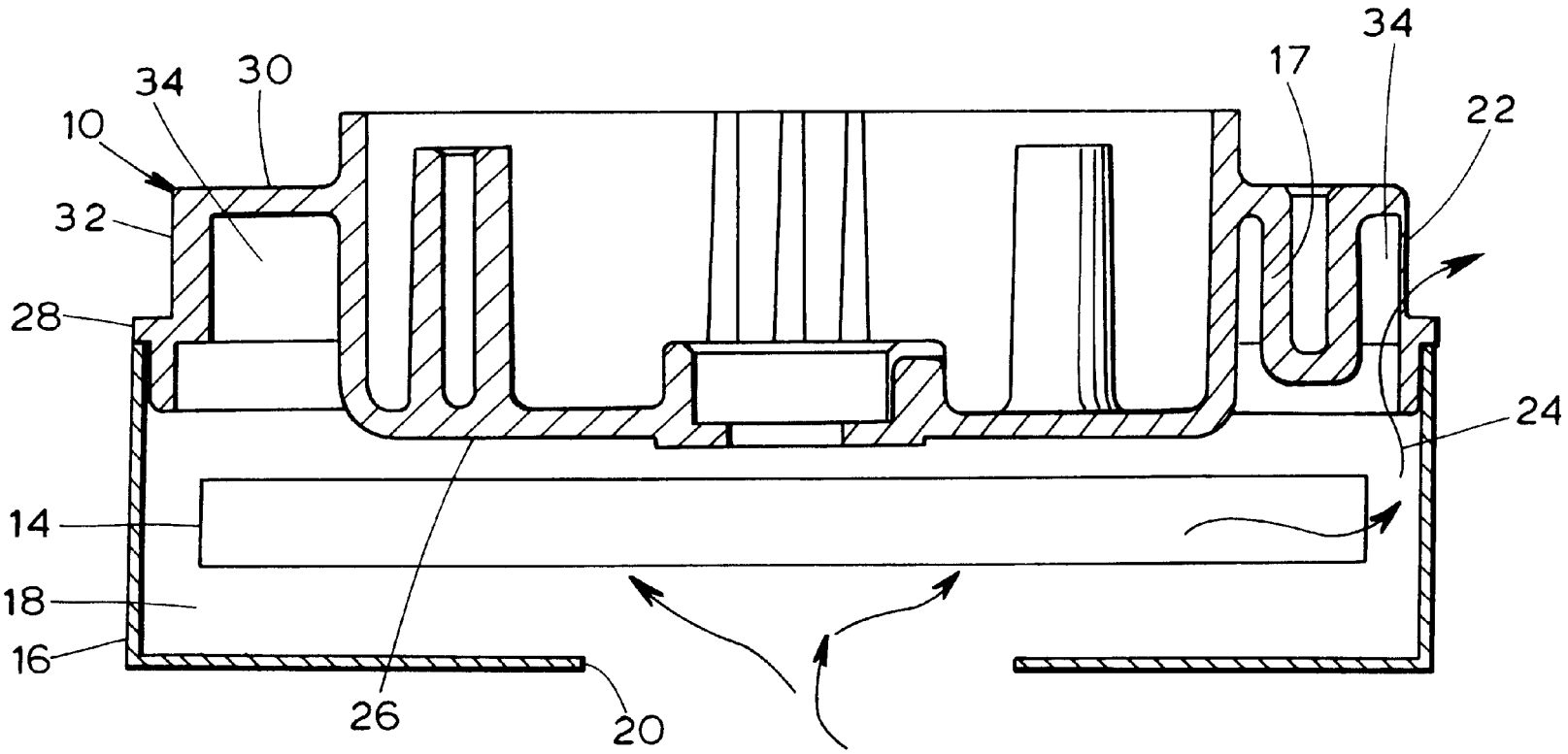
FIG. 3 is an enlarged fragmentary view in section of the motor housing according to the present invention taken along lines 3—3 of FIG. 2.

Referring now to FIGS. 2 and 3, the motor housing 10 is preferably circular in shape, and includes a central body portion 26, a peripheral rim 28 and an interconnecting wall or base 30. A portion of the peripheral rim 28 defines a sidewall 32, with the plurality of air outlets 22 being defined in the sidewall 32. The body portion 26, the base 30, and the sidewall 28 cooperate to circumscribe three sides of an upper portion 34 of the working air chamber 18. As can be seen in each of FIGS. 2, 3 and 4, air circulates through the upper portion 34 of the working air chamber 18 in response to rotation of the impeller 14.

Figure 4:
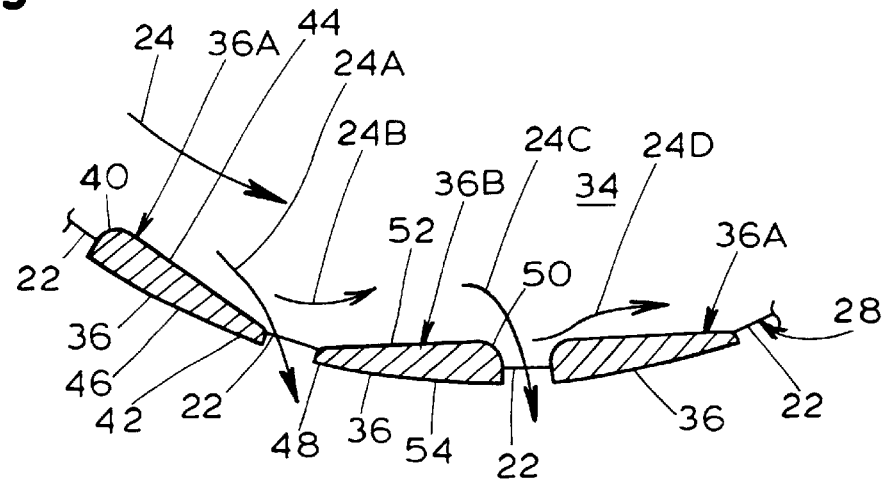
FIG. 4 is an enlarged fragmentary view taken along a portion of the housing sidewall and illustrating the cross-sectional shape of the exhaust blades or vanes.

As shown in FIGS. 2 and 4, a plurality of blades or vanes 36 are defined in and spaced about the periphery of the sidewall 28. In response to the rotation of the impeller 14, the air moves through the upper portion 34 of the working air chamber 18 along the flow path 24 in a generally counter-clockwise direction. It will be understood, however, that the direction of the air flow through the upper portion 34 of the working air chamber 18 will depend upon the rotational direction of the impeller 14. It will also be understood that the function and operation of the motor housing 10 described herein will be the same regardless of the rotational direction of the impeller 14.

Each of the vanes 36 is separated from the adjacent vanes 36 on either side by the air outlets 22. As can be seen to advantage in FIG. 4, there are two types of vanes, 36*a* and 36*b*. Each of the vanes 36*a* and 36*b* includes an airfoil shaped cross-section 38*a*, and 38*b*, respectively. Vane 36*a* includes a broadened leading edge 40 (which faces the oncoming air flowing along the path 24), a narrowed trailing edge 42, and an inner surface 44 facing the upper portion 34 of the working air chamber 18. The inner surface 44 is positioned to direct a portion 24*a* of the air through an adjacent one of the air outlets 22. The vane 36*a* also includes a curved outer surface 46 which generally corresponds to the curvature of the sidewall 28.

Similarly, vane 36*b* includes a narrowed leading edge 48, a broadened trailing edge 50, and an inner surface 52 facing the upper portion 34 of the working air chamber 18. The vane 36*b* also includes a curved outer surface 54 which generally corresponds to the curvature of the sidewall 28. The leading edge 48 in conjunction with the return surface 52 directs a portion 24*b* of the air back into the flow path 24, such that the portion 24*b* has a velocity and direction that differs from the velocity and direction prevailing within the flow path 24. The pattern of air exhaust followed by air re-introduction is explained in greater detail below.

As can be seen in both of FIGS. 2 and 4, the orientation of the vanes 36*a* and 36*b* is such that the cross-sections 38*a* and 38*b* face in opposite directions, the importance of which will be explained in greater detail below. Preferably, there are a total of eighteen vanes 36, with nine vanes 36*a* and nine vanes 36*b*. A greater or fewer number may be provided, depending on the demands of the contemplated application. Preferably, the vanes 36 are integrally formed into the housing 10, such that the central body portion 26, the peripheral rim 28, the interconnecting base 30, and the sidewall 32 are molded into a single unit using well known molding practices.

In operation, the motor assembly 12 and the motor 15 operate to rotate the impeller 14 within the lower housing 16 in order to draw air into the opening 20 in the lower housing 16 and into the working air chamber 18 in a manner that is well known to those skilled in the art. Continued rotation of the impeller 14 constantly draws air through the opening 20, so that the working air is moved along the flow path 24 between the opening 20 and the air outlets 22 spaced about the periphery of the sidewall 28. In the process, the air is forced into the upper portion 34 of the working air chamber 18, wherein the air follows the generally circular path shown to advantage on FIGS. 2 and 4.

As shown in FIGS. 2 and 4, as the air proceeds along the path 24 within the upper portion 34 defined by the housing 10, the air is constantly influenced by the presence of the paired vanes 36*a* and 36*b*. When the air traveling through the housing 10 along the path 24 confronts the vanes 36, a portion 24*a* of the air follows the inner surface 44 of the vane 36*a* such that the portion 24*a* exits the housing 10 through one of the air outlets 22. An excess portion 24*b* of the air is directed by the inner surface 52 of the adjacent blade 36*b* such that the excess portion 24*b* is deflected or otherwise directed back into the flow path 24. As the air passes the vane 36*b*, a portion 24*c* exits through the next outlet 22, while another portion 24*d* is directed back into the flow path 24 by the next subsequent vane 36*a*. The process is repeated as the air encounters successive pairs of vanes 36*a* and 36*b* around the periphery of the sidewall 28.

Each time the air is interrupted by the vanes 36*a* and 36*b*, those portions of the air re-entering the flow path 24, i.e. portions 24*b* and 24*d*, re-enter the flow path at a velocity and direction that differs from the ambient velocity and direction prevailing within the upper portion 34 of the working air chamber 18. The resulting differential in velocity and direction reduces the extent to which the air flow through the outlets 22, and air flowing within the upper chamber 34, will be synchronized, which reduction produces a corresponding reduction in ambient noise levels produced by harmonized air flow.

It will be understood that the above description does not limit the invention to the above-given details. It is contemplated that various modifications and substitutions can be made without departing from the spirit and scope of the following claims.

What is claimed:

1. A motor housing for a vacuum cleaner, comprising:

a main body, a peripheral rim, and an interconnecting base bounding portions of a working air chamber; and a portion of the peripheral rim defining a sidewall having a plurality of vanes and a plurality of exhaust openings, the vanes and the exhaust openings cooperating to exhaust air from the working air chamber;

wherein each of the vanes has an airfoil shaped cross-section, the airfoil of each vane being oriented oppositely relative to the airfoil of its adjacent vanes.

2. The housing of claim 1, wherein there are an even number of vanes.

3. The housing of claim 1, wherein there are eighteen vanes.

4. The housing of claim 1, wherein a first set of the vanes are positioned to direct a portion of the air through the exhaust openings and wherein a second set of the vanes are positioned to direct another portion of the air from adjacent the exhaust openings toward the chamber.

5. The housing of claim 4, wherein the vanes in the first set are separated by the vanes in the second set.

6. The housing of claim 1, including a rotatable impeller housed within an enclosure for forcing air into the housing for movement along a path from an upstream location to a downstream location in response to rotation of the impeller, and wherein each vane has an upstream facing leading edge and a downstream facing trailing edge.

7. The housing of claim 6, wherein every other vane includes a broadened leading edge and a narrowed trailing edge, and wherein every other adjacent vane includes a narrowed leading edge and a broadened trailing edge.

8. The housing of claim 4, wherein each of the vanes in the first set includes an exit surface for directing air away from the path and through an adjacent one of the exhaust openings, and wherein a each of the vanes in the second set includes a return surface for directing an excess portion of the air back into the path.

9. The housing of claim 1, wherein each of the vanes is formed integrally with the main body, the peripheral rim, and the interconnecting base.

10. A housing for a vacuum device, comprising:

a main body, a peripheral rim, and an interconnecting base bounding portions of a working air chamber;

a portion of the peripheral rim defining a sidewall having a plurality of vanes, and wherein each of the vanes has a wedge-shaped cross section and is separated from its adjacent vanes by an exhaust opening, the vanes and the exhaust openings cooperating to exhaust air from the working air chamber, the wedge-shaped cross section of each of the vanes being oriented oppositely relative to the wedge-shaped cross section of its adjacent vanes.

11. The housing of claim 10, wherein there are an even number of vanes.

12. The housing of claim 10, wherein there are eighteen vanes.

13. The housing of claim 10, wherein a first set of the vanes are positioned to direct air through the exhaust openings and wherein a second set of the vanes are positioned to direct air away from the exhaust openings.

14. The housing of claim 13, wherein the vanes in the first set are separated by the vanes in the second set.

15. The housing of claim 13, wherein air flows through the housing along a path from an upstream location to a downstream location in response to rotation of an impeller, and wherein the first set of vanes includes a thickened upstream facing leading edge and further wherein the second set of vanes includes a narrowed upstream facing leading edge.

16. The housing of claim 13, wherein each of the vanes in the first set includes an exit surface for directing air away from the path and through an adjacent one of the exhaust openings, and wherein a each of the vanes in the second set includes a return surface for directing an excess portion of the air back into the path.

17. The housing of claim 10, wherein each of the vanes is formed integrally with the main body, the peripheral rim, and the interconnecting base.

18. A vacuum cleaner housing, comprising:

a main body, a peripheral rim, and an interconnecting base bounding portions of a working air chamber;

a portion of the peripheral rim defining a sidewall, the sidewall including exhaust vane means defined in part by a plurality of paired vane units spaced circumferentially about peripheral rim, the sidewall further including a plurality of exhaust openings cooperating with the vane means to exhaust air from the housing.

19. The housing of claim 18, including an impeller mounted for rotation within the housing, and wherein air flows through the housing along a path from an upstream location to a downstream location in response to rotation of the impeller.

20. The housing of claim 18, wherein each of the vane units is formed integrally with the sidewall.

21. An impeller housing for a vacuum cleaner, comprising:

a main body, a peripheral rim, and an interconnecting base bounding portions of a working air chamber for confining air moving along a path, a portion of the peripheral rim defining a sidewall; and exhaust means for exhausting air from the chamber, the exhaust means including exit vane means integrally formed in and circumferentially spaced about the sidewall for exhausting air from the chamber, the exhaust means further including recirculation vane means integrally formed in and spaced circumferentially about the sidewall for recirculating air in the chamber.

22. A vacuum cleaner housing, comprising:

a main body, a peripheral rim, and an interconnecting base bounding portions of a working air chamber;

a portion of the peripheral rim defining a sidewall, the sidewall including exhaust vane means defined in part by a plurality of paired vane units spaced circumferentially about the peripheral rim, the sidewall further including a plurality of exhaust openings cooperating with the vane means to exhaust air from the housing, an upstream portion of each vane unit being positioned to direct air through an adjacent exhaust opening, and a downstream portion of each vane unit being positioned to direct air away from the exhaust openings.

23. The housing of claim 22, wherein each of the upstream vane portions includes an exit surface for directing air toward an adjacent exhaust opening and further wherein each of the downstream vane units includes a return surface for directing an excess portion of the air away from the exhaust openings.

* * * * *